US010023811B2

(12) United States Patent
Soliman et al.

(10) Patent No.: US 10,023,811 B2
(45) Date of Patent: Jul. 17, 2018

(54) INTEGRATED GAS OIL SEPARATION PLANT FOR CRUDE OIL AND NATURAL GAS PROCESSING

(71) Applicant: Saudi Arabian Oil Company, Dhahran (SA)

(72) Inventors: Mohamed Soliman, Ras Tanura (SA); Samusideen Adewale Salu, Ras Tanura (SA); Talal Al-Zahrani, Khobar (SA); Nisar Ahmad K. Ansari, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 72 days.

(21) Appl. No.: 15/259,197

(22) Filed: Sep. 8, 2016

(65) Prior Publication Data

US 2018/0066194 A1 Mar. 8, 2018

(51) Int. Cl.

| | |
|---|---|
| ***C10G 33/00*** | (2006.01) |
| ***C10G 7/00*** | (2006.01) |
| ***C10G 5/06*** | (2006.01) |

(52) U.S. Cl.

CPC ..... *C10G 7/00* (2013.01); *C10G 5/06* (2013.01); *C10G 33/00* (2013.01); *C10G 2300/205* (2013.01); *C10G 2300/207* (2013.01); *C10G 2300/208* (2013.01)

(58) Field of Classification Search

CPC ..... B01J 2219/00006; C10G 33/00

See application file for complete search history.

(56) References Cited

U.S. PATENT DOCUMENTS

| | | | |
|---|---|---|---|
| 2,327,534 | A | 8/1943 | Pierre |
| 2,952,616 | A | 9/1960 | Hausch |
| 4,180,457 | A | 12/1979 | Fotescu |
| 4,308,131 | A | 12/1981 | Bannon |
| 4,673,488 | A | 6/1987 | Turner |
| 4,824,445 | A | 4/1989 | Minkkinen |

(Continued)

OTHER PUBLICATIONS

S. Kocal and A. Ghamdi, Performance Appraisals of Gas/Oil Separation Plants, SPE Production and Operations (May 2008), pp. 287-296.*

(Continued)

*Primary Examiner* — Randy Boyer
(74) *Attorney, Agent, or Firm* — Bracewell LLP; Constance G. Rhebergen; Kevin R. Tamm

(57) ABSTRACT

Systems and methods of integrated gas oil separation are disclosed. Systems include a high pressure production trap (HPPT), a low pressure production trap (LPPT), a low pressure degassing tank (LPDT), a first knockout drum (KOD) fluidly coupled to the LPDT and operable to accept an atmospheric pressure off-gas from the LPDT, an atmospheric pressure compressor fluidly coupled to the first KOD and operable to compress the atmospheric pressure off-gas to introduce the atmospheric pressure off-gas from the LPDT into the LPPT inlet feed stream, a second KOD fluidly coupled to the LPPT and operable to accept a low pressure off-gas from the LPPT, and a low pressure compressor fluidly coupled to the second KOD and operable to compress the low pressure off-gas to introduce the low pressure off-gas from the LPPT into the crude oil inlet feed stream.

10 Claims, 3 Drawing Sheets

(56) References Cited

U.S. PATENT DOCUMENTS

| | | | |
|---|---|---|---|
| 5,030,339 | A | 7/1991 | Czarnecki |
| 5,464,522 | A | 11/1995 | Edmondson |
| 6,045,659 | A | 4/2000 | Bjoerkhaug |
| 6,729,145 | B1 | 5/2004 | Overaa |
| 6,860,979 | B2 | 3/2005 | Sams |
| 7,223,895 | B2 | 5/2007 | Sumner |
| 7,568,363 | B2 | 8/2009 | Runbalk |
| 7,749,459 | B2 | 7/2010 | Nilsen |
| 7,982,086 | B2 | 7/2011 | Almering |
| 8,591,714 | B2 | 11/2013 | Sams |
| 8,790,509 | B2 | 7/2014 | Vu |
| 9,039,884 | B2 | 5/2015 | Bjorklund |
| 2005/0006086 | A1 | 1/2005 | Gramme Per |
| 2008/0251421 | A1 | 10/2008 | Liverud |
| 2012/0253705 | A1 | 10/2012 | Chen |
| 2013/0026082 | A1 | 1/2013 | Al-Shafei et al. |
| 2014/0001097 | A1 | 1/2014 | Jothy |
| 2016/0193612 | A1 | 7/2016 | Akdim |

OTHER PUBLICATIONS

Dr. Sahar; Petroleum Field Operations; Cairo University—Faculty of Engineering Chemcial Engineering Department Fourth Year; pp. 1-35.

Bianco; "Treatment plants for oil production"; Exploration, Production and Transport vol. 1; pp. 643-679.

International Search Report and Written Opinion for related PCT application PCT/US2017/050594 dated Nov. 27, 2017.

Kokal, S et. al,; Performance Appraisals of Gas/oil-Separation Plants; SPE Production & Operations; May 2008, XP055423490; pp. 287-296.

Devold, Hevard. "Oil and gas production handbook." (2006). 162 pages.

* cited by examiner

INTEGRATED GAS OIL SEPARATION PLANT FOR CRUDE OIL AND NATURAL GAS PROCESSING

BACKGROUND

Field

The present disclosure relates to gas oil separation plant (GOSP) technology. In particular, the disclosure relates to integrating the three-phase separation function of knockout drums (KOD's) with existing crude oil separation equipment to create efficient GOSP systems and processes.

Description of Related Art

In general, a GOSP is a continuous separation process used to refine crude oil, which includes a high pressure production trap (HPPT), a low pressure production trap (LPPT), a low pressure degassing tank (LPDT), a dehydrator unit, first and second stage desalting units, a water/oil separation plant (WOSEP), a stabilizer column, centrifugal pumps, heat exchangers, and reboilers. In a GOSP, vessel pressure is often reduced in several stages to allow the controlled separation of volatile components, such as entrained vapors. Goals of a GOSP include achieving maximum liquid recovery with stabilized oil separated from gas, and water separated from gases and oil. In other words, one purpose of a GOSP is to remove water, salt, and volatile hydrocarbon gases from wet crude oil after it is obtained from a hydrocarbon-bearing reservoir.

However, a large pressure reduction in a single separator will cause flash vaporization, leading to instability and safety hazards. Thus, in prior art GOSP's, many stages and units are required. In a first stage, gas, crude oil, and free water are separated. In a second stage, crude oil is dehydrated and desalted to separate emulsified water and salt to meet certain basic sediment and water (BSW) specifications. In a third stage, crude oil is stabilized and sweetened to meet hydrogen sulfide ($H_2S$) and Reid Vapor Pressure (RVP) specifications.

GOSP's are oftentimes operated to meet the following specifications: (1) a salt concentration of not more than about 10 pound (lbs.) of salt/1000 barrels (PTB); (2) BSW of not more than about 0.3 volume percent (V %); (3) $H_2S$ content (concentration) of less than about 60 ppm in either the crude stabilization tower (or degassing vessels in the case of sweet crude); and (4) a maximum RVP of about 7 pounds per square inch absolute (psia) and a maximum true vapor pressure (TVP) of about 13.5 psia at 130 degrees Fahrenheit (° F.). Certain characteristics of conventional GOSP systems and processes are described further with regard to FIG. 1.

SUMMARY

The present disclosure describes integrated GOSP systems and processes that meet crude oil export specifications and use less processing units than prior art GOSP's. By integrating the phase separation function of knockout drums (KOD's) within certain pre-existing gas/oil separation vessels, advantageously and unexpectedly efficient processes and systems are obtained. Systems and methods of the present disclosure can achieve crude oil export specifications including: (1) a salt concentration of not more than about 10 PTB; (2) BSW of not more than about 0.3 V %; (3) $H_2S$ content of less than about 60 ppm in either the crude stabilization tower (or degassing vessels in the case of sweet crude); and (4) a maximum RVP of about 7 psia and a maximum TVP of about 13.5 psia at 130° F.

Embodiments of systems and methods of the disclosure provide atmospheric pressure gas and low pressure gas direct contact feed streams, originating from atmospheric pressure and low pressure compressors (following knockout drums), for mixing with incoming crude oil for processing. Systems and methods eliminate the need for gas compression after coolers and utilize compression heat to directly preheat crude oil inlet streams by mixing, which aids in water emulsion separation from crude oil and reduces capital expenditures and operating costs.

Therefore, disclosed herein is an integrated gas oil separation plant system including: a crude oil inlet feed stream; a high pressure production trap (HPPT), where the HPPT is fluidly coupled to the crude oil inlet feed stream, and where the HPPT comprises an inlet mixing device operable to thoroughly mix the crude oil inlet feed stream with an additional fluid; a low pressure production trap (LPPT), where the LPPT is fluidly coupled to the HPPT, and where the LPPT comprises an inlet mixing device operable to thoroughly mix an LPPT inlet feed stream; and a low pressure degassing tank (LPDT), where the LPDT is fluidly coupled to the LPPT. The system further includes a first knockout drum (KOD) fluidly coupled to the LPDT and operable to accept an atmospheric pressure off-gas from the LPDT; an atmospheric pressure compressor fluidly coupled to the first KOD and operable to compress the atmospheric pressure off-gas to introduce the atmospheric pressure off-gas from the LPDT into the LPPT inlet feed stream; a second KOD fluidly coupled to the LPPT and operable to accept a low pressure off-gas from the LPPT; and a low pressure compressor fluidly coupled to the second KOD and operable to compress the low pressure off-gas to introduce the low pressure off-gas from the LPPT into the crude oil inlet feed stream.

In some embodiments, the system includes at least one heat exchanger operable to heat crude oil. In other embodiments, the system includes a third KOD operable to accept a high pressure off-gas from the HPPT; a high pressure compressor fluidly coupled to the third KOD; a cooler fluidly coupled to the high pressure compressor; and a fourth KOD fluidly coupled to the cooler. Still in other embodiments, the system includes at least one dehydrator unit operable to substantially dehydrate crude oil and at least one desalter unit operable to substantially desalt crude oil. Still in yet other embodiments, the system includes a cold stabilizer, where an atmospheric off-gas outlet of the cold stabilizer is fluidly coupled to the first KOD.

In certain embodiments, the system includes an oil/water separator device operable to accept an oily water output stream from the HPPT, and accept an oily water output stream from the LPDT, and the oil/water separator device is operable to separate oil from water, and operable to recycle oil to the LPDT. Still in other embodiments, the cold stabilizer further comprises a stripping gas stream, where the stripping gas stream is operable to supply steam in addition to or alternative to an additional stripping gas low in $H_2S$ concentration relative to crude oil in the cold stabilizer, where the stripping gas stream is operable to lower concentration of $H_2S$ in crude oil in the cold stabilizer. In some embodiments, the system is operable to refine crude oil in the crude oil inlet feed stream to produce a refined crude oil product safe for storage and shipment meeting the following specifications: (1) a salt concentration of not more than about 10 pound (lbs.) of salt/1000 barrels (PTB); (2) basic sediment and water (BSW) of not more than about 0.3 volume percent (V %); (3) $H_2S$ concentration of less than about 60 ppm; and (4) a maximum RVP of about 7 pounds per square inch absolute (psia) and a maximum true vapor pressure (TVP) of about 13.5 psia at 130 degrees Fahrenheit (° F.).

Still in other embodiments of the system, the operating pressure within the HPPT is greater than operating pressure within the LPPT, and the operating pressure within the LPPT is greater than operating pressure in the LPDT. In yet still other embodiments, the system is operable to dehydrate, desalt, sweeten, and stabilize crude oil to produce crude oil safe for storage and shipment with only four KOD's.

Further disclosed herein is an integrated gas oil separation plant system including: a crude oil inlet feed stream; a low pressure production trap (LPPT), where the LPPT comprises an inlet mixing device operable to thoroughly mix an LPPT inlet feed stream; a low pressure degassing tank (LPDT), where the LPDT is fluidly coupled to the LPPT; and a first knockout drum (KOD) fluidly coupled to the LPDT and operable to accept an atmospheric pressure off-gas from the LPDT. The system further includes an atmospheric pressure compressor fluidly coupled to the first KOD and operable to compress the atmospheric pressure off-gas to introduce the atmospheric pressure off-gas from the LPDT into the LPPT inlet feed stream and a second KOD fluidly coupled to the LPPT and operable to accept a low pressure off-gas from the LPPT.

In some embodiments, the system further includes at least one heat exchanger operable to heat crude oil. Still in other embodiments, the system includes a low pressure compressor fluidly coupled to the second KOD and operable to compress low pressure off-gas from the LPPT; a cooler, where the cooler is fluidly coupled to the low pressure compressor; and a third KOD, where the third KOD is fluidly coupled to the cooler. In some embodiments, the system includes at least one dehydrator unit operable to substantially dehydrate crude oil and at least one desalter unit operable to substantially desalt crude oil. In some embodiments, the system includes a cold stabilizer, where an atmospheric off-gas outlet of the cold stabilizer is fluidly coupled to the first KOD.

In other embodiments, the system includes an oil/water separator device operable to accept an oily water output stream from the LPPT, and accept an oily water output stream from the LPDT, and the oil/water separator device is operable to separate oil from water, and operable to recycle oil to the LPDT. In some embodiments, the cold stabilizer further comprises a stripping gas stream, where the stripping gas stream is operable to supply steam in addition to or alternative to an additional stripping gas low in $H_2S$ concentration relative to crude oil in the cold stabilizer, where the stripping gas stream is operable to lower concentration of $H_2S$ in crude oil in the cold stabilizer.

Still in other embodiments, the system is operable to refine crude oil in the crude oil inlet feed stream to produce a refined crude oil product safe for storage and shipment meeting the following specifications: (1) a salt concentration of not more than about 10 pound (lbs.) of salt/1000 barrels (PTB); (2) basic sediment and water (BSW) of not more than about 0.3 volume percent (V %); (3) $H_2S$ concentration of less than about 60 ppm; and (4) a maximum RVP of about 7 pounds per square inch absolute (psia) and a maximum true vapor pressure (TVP) of about 13.5 psia at 130 degrees Fahrenheit (° F.). In some embodiments of the system, operating pressure within the LPPT is greater than operating pressure in the LPDT. And in yet other embodiments, the system is operable to dehydrate, desalt, sweeten, and stabilize crude oil to produce crude oil safe for storage and shipment with only three KOD's.

Additionally disclosed is an integrated gas oil separation method, and the method includes the steps of: separating crude oil into a high pressure off-gas, an oily water output, and a partially dry, partially degassed crude oil output; separating the partially dry, partially degassed crude oil output into a low pressure off-gas, and a further partially dry, further partially degassed crude oil output; removing condensates from the low pressure off-gas; and compressing the low pressure off-gas. The method further includes the steps of separating the further partially dry, further partially degassed crude oil output into an atmospheric pressure off-gas, an oily water output, and a substantially degassed, partially dry crude oil output; removing condensates from the atmospheric pressure off-gas; compressing the atmospheric pressure off-gas; increasing the temperature of the crude oil with the compressed low pressure off-gas; and increasing temperature of the partially dry, partially degassed crude oil output with the compressed atmospheric pressure off-gas.

In some embodiments, the method includes the steps of removing condensates from the high pressure off-gas; compressing the high pressure off-gas; cooling the high pressure off-gas; and removing condensates from the compressed high pressure off-gas. Still in other embodiments the method includes the steps of substantially dehydrating the substantially degassed, partially dry crude oil output and substantially desalting the substantially degassed, partially dry crude oil output to produce a substantially degassed and substantially dry crude oil output. In some embodiments, the method includes the steps of cold stabilizing the substantially degassed and substantially dry crude oil output; removing condensates from an atmospheric off-gas of the cold stabilizing of the substantially degassed and substantially dry crude oil output; and compressing the atmospheric off-gas of the cold stabilizing of the substantially degassed and substantially dry crude oil output to heat the partially dry, partially degassed crude oil output.

Still in other embodiments, the method includes the steps of separating oily water into oil and water and recycling the oil for further processing. In certain embodiments, the method further comprises the step of gas stripping the substantially degassed and substantially dry crude oil output, where the step of gas stripping is operable to lower concentration of $H_2S$ in the substantially degassed and substantially dry crude oil output. Still in other embodiments, the method is operable to refine crude oil to produce a refined crude oil product safe for storage and shipment meeting the following specifications: (1) a salt concentration of not more than about 10 pound (lbs.) of salt/1000 barrels (PTB); (2) basic sediment and water (BSW) of not more than about 0.3 volume percent (V %); (3) $H_2S$ concentration of less than about 60 ppm; and (4) a maximum RVP of about 7 pounds per square inch absolute (psia) and a maximum true vapor pressure (TVP) of about 13.5 psia at 130 degrees Fahrenheit (° F.). In certain embodiments, the method is operable to dehydrate, desalt, sweeten, and stabilize crude oil to produce crude oil safe for storage and shipment with only four knock out drums (KOD's).

Additionally disclosed is an integrated gas oil separation method including the steps of: separating crude oil into a low pressure off-gas, an oily water output, and a partially dry, partially degassed crude oil output; separating the partially dry, partially degassed crude oil output into an atmospheric pressure off-gas, an oily water output, and a substantially degassed, partially dry crude oil output; removing condensates from the atmospheric pressure off-gas; compressing the atmospheric pressure off-gas; and increasing the temperature of the crude oil with the compressed low pressure off-gas. In certain embodiments, the method includes the steps of removing condensates from the low pressure off-gas; compressing the low pressure off-gas; cooling the low pressure off-gas; and removing condensates from the cooled low pressure off-gas. Still in other embodiments, the method includes the steps of substantially dehydrating the substantially degassed, partially dry crude oil output and substantially desalting the substantially degassed, partially dry crude oil output to produce a substantially degassed, substantially dry crude oil output.

Still in other embodiments, the method includes the steps of cold stabilizing the substantially degassed, substantially dry crude oil output; removing condensates from an atmospheric off-gas of the substantially degassed, substantially dry crude oil output; and compressing the atmospheric off-gas of the cold stabilizing of the substantially degassed, substantially dry crude oil output to heat the crude oil. In certain embodiments, the method includes the steps of separating oily water into oil and water and recycling the oil for further processing.

In yet other embodiments, the method includes the step of gas stripping the substantially degassed, substantially dry crude oil output, where the gas stripping is operable to lower concentration of $H_2S$ in the substantially degassed, substantially dry crude oil output. In some embodiments, the method is operable to refine crude oil to produce a refined crude oil product safe for storage and shipment meeting the following specifications: (1) a salt concentration of not more than about 10 pound (lbs.) of salt/1000 barrels (PTB); (2) basic sediment and water (BSW) of not more than about 0.3 volume percent (V %); (3) $H_2S$ concentration of less than about 60 ppm; and (4) a maximum RVP of about 7 pounds per square inch absolute (psia) and a maximum true vapor pressure (TVP) of about 13.5 psia at 130 degrees Fahrenheit (° F.). And still in other embodiments, the method is operable to dehydrate, desalt, sweeten, and stabilize crude oil to produce crude oil safe for storage and shipment with only three knock out drums (KOD's).

BRIEF DESCRIPTION OF THE DRAWINGS

These and other features, aspects, and advantages of the disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION

While the disclosure will be described in connection with several embodiments, it will be understood that it is not intended to limit the disclosure to those embodiments. On the contrary, it is intended to cover all the alternatives, modifications, and equivalents as may be included within the spirit and scope of the disclosure defined by the appended claims.

Figure 1:
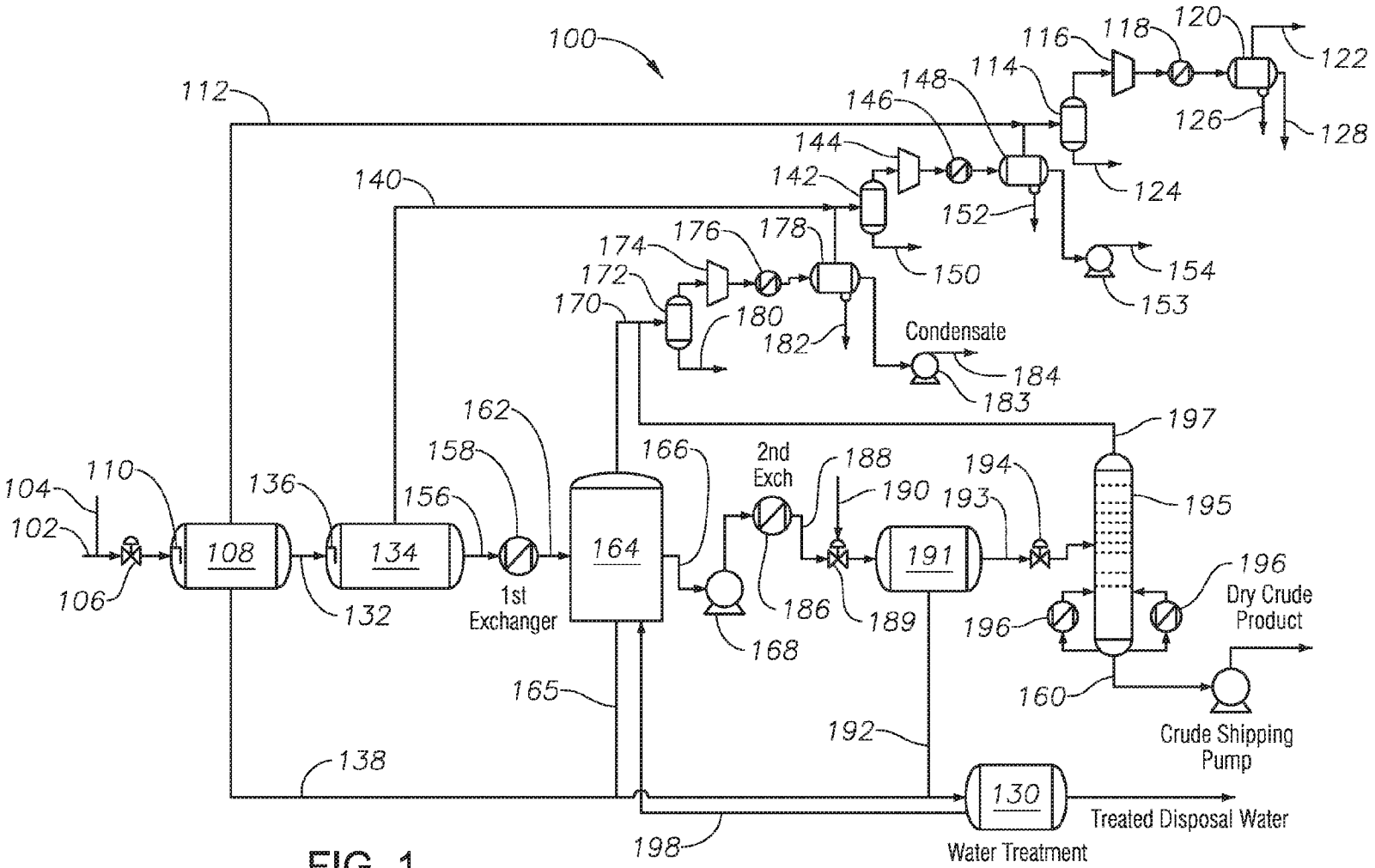
FIG. 1 (Prior Art)
FIG. 1 is a schematic diagram showing a conventional GOSP system and process for processing crude oil and gas from production wells in a hydrocarbon-bearing formation.

Referring first to FIG. 1, a schematic diagram is provided showing a conventional GOSP system and process for processing crude oil and gas from production wells in a hydrocarbon-bearing formation. Conventional GOSP's suffer from many deficiencies including low product yield, inefficient use of available heat sources such as for example the discharge streams of compressors, many separate units being used to meet product specification, high operating costs due to heating requirements, a large spatial footprint, and high capital cost.

In general, a GOSP is a continuous separation system and process that includes a high pressure production trap (HPPT), a low pressure production trap (LPPT), a low pressure degassing tank (LPDT), a dehydrator unit, first and second stage desalting units, a water/oil separation Plant (WOSEP), a stabilizer column, atmospheric compressors, low pressure compressors, high pressure compressors, centrifugal pumps, heat exchangers, and reboilers. In a conventional GOSP, pressure is often reduced in several stages to allow for the controlled separation of volatile components. Objectives of a GOSP include achieving maximum liquid recovery of stabilized oil and water, and gas separation. However, a large pressure reduction in a single separator will cause flash vaporization, leading to instability and safety hazards.

In other words, GOSP's degas, dehydrate, desalt, stabilize, and sweeten wet crude oil from production wells. For example, in FIG. 1, conventional GOSP system and process 100 includes a crude oil feed stream inlet 102 comprising wet crude oil, and crude oil feed stream inlet 102 is fluidly coupled to a demulsifier injection port 104, a slug valve 106, and a HPPT 108. HPPT 108 includes an inlet diverter 110 for thoroughly mixing wet crude oil with any other additives, such as one or more demulsifiers. In HPPT 108, crude oil undergoes an initial three-phase separation to remove most of the gasses and free-formation water. A pressure drop in a HPPT 108 causes lighter hydrocarbon gases in the crude oil, such as for example $C_1$-$C_4$ hydrocarbons, to separate from the heavier liquid hydrocarbons.

The phrase lighter hydrocarbons refers to $C_1$-$C_4$ hydrocarbons such as, for example, methane, ethane, propane, butane, iso-butane, and, optionally, trace $C_5$ compounds. The phrase heavier hydrocarbons refers to $C_5$ and greater hydrocarbons such as, for example, pentane, iso-pentane, and hexane.

High pressure off-gas from HPPT 108 proceeds via high pressure gas stream 112 to a suction KOD 114, a high pressure compressor 116, a cooler 118, and a discharge KOD 120. A tops stream 122 from discharge KOD 120 comprises high pressure gas which proceeds to dehydration and dewpoint control units by tops stream 122. Condensate flows from suction KOD 114 and discharge KOD 120 proceed by condensate outlet streams 124, 126, 128. Gas is compressed in high pressure compressor 116 and then cooled to condense hydrocarbons and other gases heavier than ethane, before being directed to the discharge KOD 120 and other dehydration and dewpoint control units by tops stream 122.

Condensed fluids from suction KOD 114 and discharge KOD 120, such as for example water and other heavy liquid condensates, are discharged for collection and treatment in an oil/water separation unit, such as for example oil/water separation unit 130. The operating conditions in HPPT 108 include temperature in a range from about 65° F. to about 130° F. and operating pressure at about 150 pounds per square inch gauge (psig). Knockout drums, such as vacuum KOD's, are used to "knockout" or separate any liquid droplets from gas, for example before entering a compressor to avoid the liquid damaging a compressor.

Wet crude oil in HPPT outlet stream 132 proceeds to a LPPT 134, through inlet diverter 136. Oily water in oily water outlet stream 138 proceeds to oil/water separation unit 130. Wet crude oil in HPPT outlet stream 132 still contains some water and gas after HPPT 108, and proceeds to the next stage in conventional GOSP system and process 100, which is the LPPT 134 for removing any remaining off-gas. LPPT 134 is a horizontal two-phase separation vessel that separates certain remaining off-gas from the wet crude oil. LPPT 134 operates at a lower pressure than HPPT 108, in some embodiments at about 50 psig. Low pressure off-gas from LPPT 134 proceeds by low pressure off-gas stream 140 to a suction KOD 142, a low pressure compressor 144, a cooler 146, a discharge KOD 148, and suction KOD 114. Condensate proceeds by condensate outlet streams 150, 152, 154, optionally for collection and treatment in an oil/water separation unit, such as for example oil/water separation unit 130.

Low pressure off-gas is compressed in a low pressure compressor 144, and then it is cooled in cooler 146 to condense materials heavier than ethane before being directed to the high pressure compression train including units 114, 116, 118, and 120. Operating conditions in the LPPT include temperature ranging from about 65° F. to about 130° F. and pressure at about 50 psig.

Wet crude oil in LPPT outlet stream 156 from LPPT 134 proceeds to a wet-dry crude oil heat exchanger 158, where heat is recovered from a stabilizer product bottom stream, such as for example stabilizer product bottom stream 160, which reheats oil, water, and any remaining gas mixed in LPPT outlet stream 156. Heating wet crude oil allows for easier separation of water from crude oil. Water cut in oil production refers to the total volume of water in the crude oil stream divided by the total volume of crude oil. Water cut in crude oil increases with oil well age. Water cut at the beginning of oil well life is around zero and reaches close to 100% by the end of the oil well's life.

Heating of crude oil improves oil/water separation by allowing the coalescence of water droplets and settling out of water in the liquid phase, and heating also encourages degassing of crude oil to stabilize the crude. Heated crude oil stream 162 from wet-dry crude oil heat exchanger 158 proceeds a LPDT 164 with pressure between about 3 psig and about 5 psig. LPDT 164 is a three-phase separator where pressure is reduced to about 3 psig so that substantially any remaining heavy gas components, such as for example trace $C_5$ hydrocarbons, $H_2S$, and $CO_2$, can boil off and be removed. Operating conditions in the LPDT 164 include temperature in a range from about 65° F. to about 130° F. and pressure at about 3 psig to about 5 psig.

Outputs from LPDT 164 include wet, degassed crude oil, which proceeds by wet, degassed crude oil stream 166 to crude charge pumps 168, and atmospheric off-gas, which proceeds by atmospheric off-gas stream 170 to suction KOD 172, atmospheric pressure compressor 174, cooler 176, and discharge KOD 178. Oily water proceeds by stream 165 to oil/water separation unit 130 to separate oil from water. Atmospheric pressure off-gas is compressed in atmospheric pressure compressor 174, and then it is cooled in cooler 176 to condense hydrocarbons and other off-gases heavier than ethane before being directed to the low pressure compressor chain including units 142, 144, 146, and 148. Condensate proceeds by condensate outlet streams 180, 182, 184, to oil/water separation unit 130 optionally for collection and treatment in an oil/water separation unit, such as for example oil/water separation unit 130.

Wet, degassed crude oil stream 166 from LPDT 164 is pumped by crude charge pumps 168 to a trim heat exchanger 186 to increase temperature of wet, degassed crude oil stream 166. Heated, wet degassed crude oil stream 188 is then passed to a mixing valve 189, in which heated, wet degassed crude oil stream 188 is mixed with a fresh wash water stream 190, before entering dehydrating and desalting unit 191 for further oil/water separation. Heating wet, degassed crude oil stream 166 enhances the efficiency of dehydrating and desalting unit 191. Heat exchangers in embodiments of the present disclosure can be tube/shell type in which cold, wet crude oil passes though the tubes and the heating medium is placed inside an outer shell.

A dehydrator is a horizontal vessel where a first stage of drying wet crude oil takes place. Washing and electrostatic coalescence of water takes place in a dehydrator vessel along with or alternative to desalter units, such as for example dehydrating and desalting unit 191, for further oil/water separation. Wet crude oil input into a dehydrator unit still contains some free salty water, and salty water in the form of an emulsion. The emulsion is separated into layers of oil and water by electrostatic coalescence. Electrostatic coalescence applies an electric current, causing water droplets in an emulsion to collide, coalesce into larger (heavier) drops, and settle out of the crude oil as separate liquid water. This process partially dries wet crude oil. Oily water proceeds to the oil/water separation unit 130 by stream 192 for treatment and oil water separation. Operating conditions of a dehydrator unit include temperature in a range of from about 130° F. to about 160° F., and a pressure at about 25 psig above the crude oil vapor pressure.

Optionally, partially-dried crude oil, still containing some salty water in emulsion, goes to a first stage desalter unit. Partially dried crude oil proceeds from a dehydrator unit to a first stage desalter, such as for example in dehydrating and desalting unit 191. In an optional first stage desalter, partially dried crude oil is mixed with recycled effluent water from an optional second stage desalter in a mixing valve. Effluent water from an optional first stage desalter can proceed to the dehydrator for washing crude oil. Operating conditions of a first stage desalter can include temperature in a range from about 130° F. to about 160° F. and a pressure at about 25 psig above the crude oil vapor pressure.

A second stage desalter, for example a unit in dehydrating and desalting unit 191, is generally the final stage of wet crude oil processing in a GOSP. Partially dried crude oil proceeds to a second stage desalter from the first stage desalter. Fresh wash water (low in salt concentration relative to the crude oil) is injected into an inlet of a second stage desalter mixing valve. Low salinity wash water rinses the remaining salt from the crude oil.

Fresh wash water is used in the desalter process to ensure that the maximum amount of salt is rinsed from the wet crude oil. Electrostatic coalescence removes substantially any remaining water emulsion from the wet crude oil in the second stage desalter in the same way as a dehydrator unit and a first stage desalter. Effluent water from a second stage desalter goes to the first stage desalter as wash water. Operating conditions of a second stage desalter include temperature in a range from about 130° F. to about 160° F., and a pressure at about at least 25 psig above the crude vapor pressure.

The output from dehydrating and desalting unit 191 is substantially dry and desalted crude oil that passes by stream 193 to a depressurizing valve 194 and then to a stabilizer 195. Stabilizer 195 includes reboilers 196. Once in stabilizer 195, the crude oil is substantially degassed, dehydrated, and desalted, and there are two more steps before the crude oil is suitable for storage, export, and refining: sweetening and stabilization.

Sweetening involves the removal of dissolved hydrogen sulfide ($H_2S$) gas from crude oil to meet specifications in a range from about 10-60 ppm $H_2S$. The purpose of sweetening is to reduce corrosion to pipelines and eliminate health and safety hazards associated with $H_2S$. Steam in addition to or alternative to any other gas low in $H_2S$ concentration relative to the crude oil to be sweetened can be used as a stripping gas for removal of $H_2S$. Stabilization is a process carried out using heating to remove any remaining dissolved gases, light, volatile hydrocarbons, and $H_2S$. Crude oil is hence split into two components: atmospheric gas from the overhead, for example at stream 197, and stabilized, sweetened crude oil from the bottoms, for example at stabilizer product bottom stream 160. Stabilizing crude oil is achieved when crude oil is heated in a multiple stages of separation drums working at increasing temperatures and reduced pressure.

Stabilizer 195 performs two functions simultaneously by sweetening sour crude oil by removing the hydrogen sulfide, and reducing the vapor pressure through removal of light, volatile hydrocarbons, thereby making the crude oil safe for shipment in pipelines. Stabilization involves the removal of light ends from crude oil, mainly $C_1$-$C_4$ hydrocarbons, to reduce the vapor pressure to produce dead or stable product that can be stored in an atmospheric tank. Stabilization aims to lower vapor pressure of crude oil to a maximum RVP of about 7 psia and a maximum TVP of about 13.5 psia at 130° F., or in other words low enough so no vapor will flash under atmospheric conditions, making it safe for transportation and shipment. Operating conditions of a stabilizer, such as for example stabilizer 195, include temperature in a range from about 160° F. to about 200° F. and pressure from about 3 psig to about 5 psig.

Oil from the dehydrating and desalting unit 191 rises to the top of stabilizer 195 and is distributed onto a top tray. Stabilizer 195 has a number of trays (for example up to about sixteen), whereby crude oil flows down over each tray until it reaches a draw-off tray. Reboilers 196, for example thermosiphon reboilers, heat dry crude oil from a draw-off tray and return it to stabilizer 195. Light components in the crude oil vaporize and rise through the stabilizer trays. Hydrogen sulfide and light hydrocarbons are removed as tops at stream 197, which is compressed in atmospheric pressure compressor 174 and then cooled in cooler 176 to condense materials heavier than ethane before being directed to the low pressure and high pressure compression trains.

Dry crude oil exits by stabilizer product bottom stream 160 from the bottom of stabilizer 195 and is discharged and collected in a dry crude oil tank before shipment to customers. Stabilizer 195 is used to meet RVP and $H_2S$ specifications. After stabilization and sweetening, the crude oil should meet all specifications required for shipment, transport, and storage. These specifications include the following: (1) a salt concentration of not more than about 10 PTB; (2) BSW of not more than about 0.3 V %; (3) $H_2S$ content of less than about 60 ppm in the crude stabilization tower (or degassing vessels in the case of sweet crude); and (4) a maximum RVP of about 7 psia and a maximum TVP of about 13.5 psia at 130° F.

Oil/water separation unit 130 collects oily water from streams from HPPT 108, LPDT 164, and dehydrating and desalting unit 191, and separates oil from the collected water. Oil/water separation unit 130 can optionally collect condensate from other KOD units in conventional GOSP system and process 100. Wastewater is discharged to disposal water wells and extracted oil is recycled and conveyed to LPDT 164 by stream 198.

In embodiments of the present disclosure, high pressure off-gases are in a pressure range from about 140 psig to about 450 psig, low pressure off-gases are in a pressure range from about 40 psig to about 100 psig, and atmospheric pressure off-gases are in a range from about 14.7 psig to about 25 psig. The temperature of the off-gases depends, in part, on the source of the crude oil. For example, the initial temperature for crude oil originating from offshore oil rigs ranges between about 55° F. to about 100° F., while the temperature of crude oil originating from onshore oil fields ranges from about 100° F. to about 150° F. For example, in one embodiment the temperature of high pressure off-gas from an HPPT is about 95° F., the temperature of low pressure off-gas from a LPPT is about 95° F. (with no heater preceding the LPPT), and the temperature of the atmospheric pressure off-gas from a LPDT is about 125° F., due to a heater (heat exchanger) preceding the LPDT.

Figure 2:
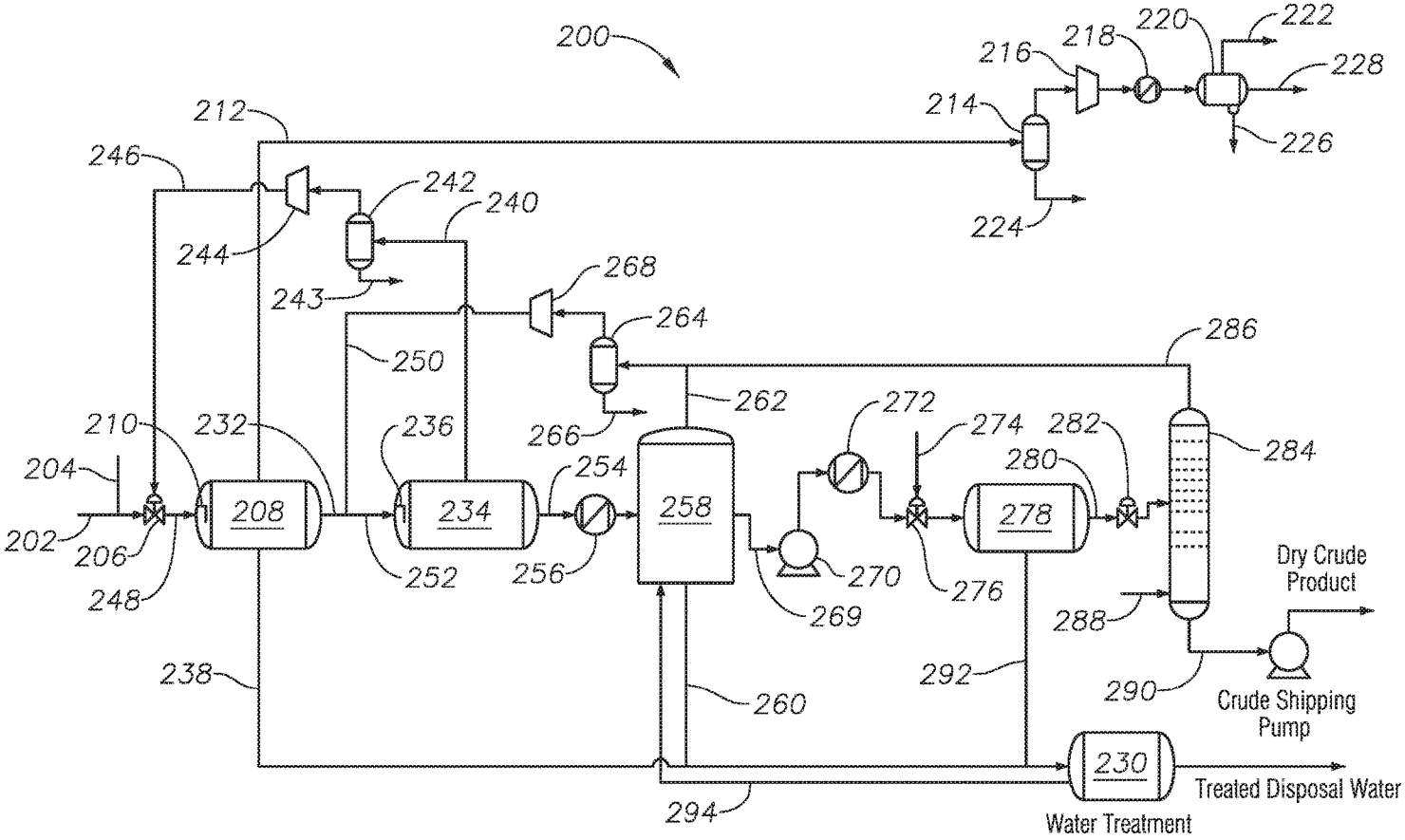
FIG. 2 is a schematic diagram showing an integrated GOSP of the present disclosure used for processing crude oil, for example light grade crude oil.
Figure 3:
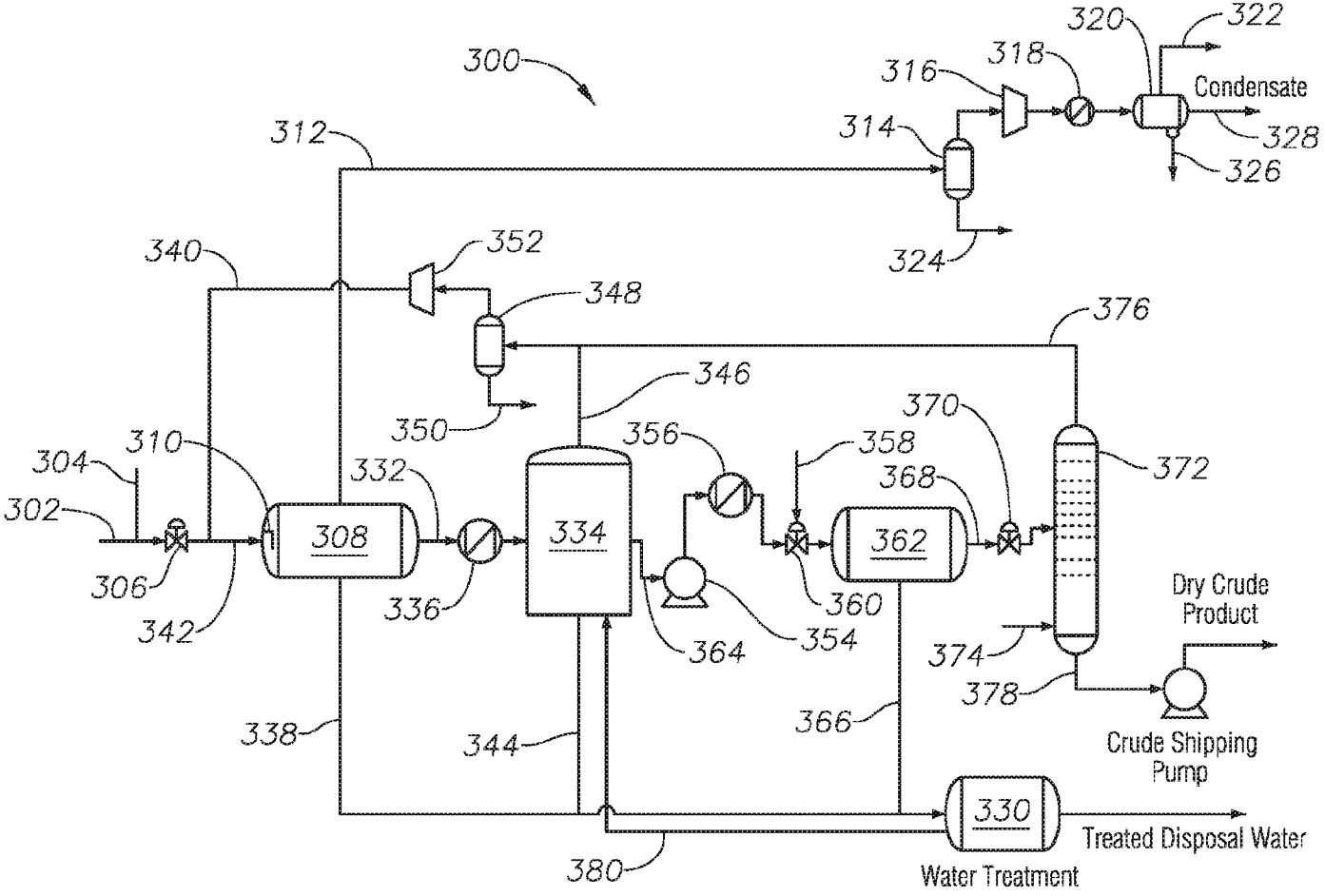
FIG. 3 is a schematic diagram showing an integrated GOSP of the present disclosure used for processing crude oil, for example medium and heavy grade crude oil.

Referring now to FIGS. 2 and 3, notably, by integrating atmospheric and low pressure compressors, such as for example atmospheric pressure compressor 174 and low pressure compressor 144, and by integrating discharge KOD's, such as for example discharge KOD's 178 and 148, and by integrating compressor after coolers, such as for example coolers 176 and 146, with existing three-phase and two-phase gas oil separation vessels, such as for example HPPT 108 and LPPT 134, certain benefits are achieved including: lower capital costs, a lower external heating requirement, increased product yield, and improved water separation efficiency.

FIG. 2 is a schematic diagram showing an integrated GOSP of the present disclosure used for processing crude oil. In FIG. 2, integrated GOSP system and process 200 includes a crude oil feed stream inlet 202 comprising wet crude oil, and crude oil feed stream inlet 202 is fluidly coupled to a demulsifier injection port 204, a mixing valve 206, and a HPPT 208. HPPT 208 includes an inlet diverter 210 for thoroughly mixing wet crude oil with any other additives, such as one or more demulsifiers. In HPPT 208, crude oil undergoes an initial three-phase separation to remove most of the gases and free-formation water. A pressure drop in a HPPT 208 causes lighter hydrocarbon gases in the crude oil, such as $C_1$-$C_4$ hydrocarbons, to separate from the heavier liquid hydrocarbons.

In some embodiments of the present disclosure, the operating temperatures of an HPPT and LPPT are substantially the same when no heater (heat exchanger) precedes the units. In some embodiments, the operating pressure of the HPPT is about 150 psig, the operating pressure of the LPPT is about 50 psig, and the operating pressure of the LPDT is about 3 psig. In some embodiments, the operating temperatures of the HPPT and LPPT are about 95° F., while the operating temperature of the LPDT is about 125° F.

High pressure gas from HPPT 208 proceeds via high pressure gas stream 212 to a suction KOD 214, a high pressure compressor 216, a cooler 218, and a discharge KOD 220. A tops stream 222 from discharge KOD 220 comprises high pressure gas which proceeds to dehydration and dewpoint control units by tops stream 222. Condensate flows from suction KOD 214 and discharge KOD 220 proceed by condensate outlet streams 224, 226, 228. Gas is compressed in high pressure compressor 216 and then cooled in cooler 218 to condense hydrocarbons and other gases heavier than ethane, before being directed to the discharge KOD 220 and other dehydration and dewpoint control units by tops stream 222. Condensed fluids from suction KOD 214 and discharge KOD 220, such as, for example, water, are discharged for collection and treatment in an oil/water separation unit, such as for example oil/water separation unit 230. The operating conditions in HPPT 208 include temperature in a range from about 65° F. to about 130° F. and operating pressure at about 150 pounds per square inch gauge (psig).

Wet crude oil in HPPT outlet stream 232 proceeds to a LPPT 234, through inlet diverter 236. Oily water in oily water outlet stream 238 proceeds to oil/water separation unit 230. Wet crude oil in HPPT outlet stream 232 still contains some water and gas after HPPT 208, and proceeds to the next stage in integrated GOSP system and process 200, which is the LPPT 234 for removing certain remaining off-gas. LPPT 234 is a horizontal two-phase separation vessel that separates the certain remaining off-gas from the wet crude oil. LPPT 234 operates at a lower pressure than HPPT 208, for example at about 50 psig. Low pressure off-gas from LPPT 234 proceeds by low pressure off-gas stream 240 to a suction KOD 242 and a low pressure compressor 244, and then proceeds by a compressed LPPT off-gas stream 246 to be mixed with crude oil feed stream inlet 202 at mixing valve 206 to form mixed HPPT feed stream 248. Condensates, such as water or other condensed fluids, are separated from low pressure gas in KOD 242 and exit by condensate exit stream 243.

By mixing hot discharge gases in compressed LPPT off-gas stream 246, in some embodiments at about 95° F., with cold crude oil in crude oil feed stream inlet 202, heavy hydrocarbons in the gas (such as for example C5+ hydrocarbons) condense into the crude oil, which will increase the yield of crude oil produced. Another advantage when mixing compressed LPPT off-gas stream 246 with stream 202 is that the heat transfer from the off-gas to the liquid will improve the emulsion separation in HPPT 208. In an example embodiment, low pressure off-gas stream 240 exits LPPT 234 at about 128° F. After compression, compressed LPPT off-gas stream 246 is at about 245° F. and about 150 psig, and crude oil feed stream inlet 202 is at about 95° F. By mixing hot discharge gases in compressed LPPT off-gas stream 246, with cold crude oil in crude oil feed stream inlet 202, the temperature of mixed HPPT feed stream 248 is increased to about 124° F.

Wet, unstabilized crude oil from oil production wells (not shown) in crude oil feed stream inlet 202 mixes with hot, low pressure compressor discharge gas before entering HPPT 208, which in some embodiments operates at about 150 psig. Low pressure off-gas from LPPT 234, once deliquified in KOD 242 and compressed in low pressure compressor 244, proceeds by compressed LPPT off-gas stream 246 to directly preheat crude oil. Heating crude oil feed stream inlet 202 enhances emulsified water separation in HPPT 208 and reduces crude oil viscosity. HPPT 208 still operates to effect an initial three-phase separation to remove most of the gasses and free water from crude oil.

Before wet crude oil in HPPT outlet stream 232 proceeds to LPPT 234, it is mixed with a compressed atmospheric off-gas stream 250 to form LPPT inlet stream 252. Compressed atmospheric off-gas stream 250 heats HPPT outlet stream 232. LPPT 234, in some embodiments, operates at about 50 psig. Heating wet crude oil in HPPT outlet stream 232 with the compressed atmospheric off-gas stream 250 allows for more efficient separation of gases from the crude oil and allows for increased water separation efficiency. Crude oil in LPPT outlet stream 254 proceeds to a first heat exchanger 256 to be heated, before entering a LPDT 258, operating at less than about 5 psig, for further gas and water separation. Heating wet crude oil allows for more efficient gas separation from the crude oil, allows for more efficient stabilizing processes, and allows for increased water separation efficiency.

From LPDT 258, an oily water stream 260 proceeds to oil/water separation unit 230 for treatment and separation. Atmospheric off-gas stream 262 proceeds to KOD 264, in which condensates such as for example water and other condensates are removed by condensate stream 266. Atmospheric off-gas proceeds to atmospheric pressure compressor 268 and then to be mixed with HPPT outlet stream 232 by compressed atmospheric off-gas stream 250 to form LPPT inlet stream 252.

Wet crude oil stream from LPDT 258 is pumped through one or more crude charge pumps 270 and is conveyed to a trim heat exchanger 272 to increase temperature of the crude oil. Fresh wash water stream 274 is mixed with wet crude oil from LPDT 258 at mixing valve 276, before proceeding to a dehydrator and desalting unit 278. Heating a wet, degassed crude oil stream 269 enhances the efficiency of dehydrating and desalting unit 278. Heat exchangers in embodiments of the present disclosure can be tube/shell types where cold, wet crude oil passes though the tubes and the heating medium is placed inside an outer shell.

A dehydrator is a horizontal vessel where a first stage of drying wet crude oil takes place. Washing and electrostatic coalescence of water takes place in a dehydrator vessel along with or alternative to desalter units, such as for example in dehydrating and desalting unit 278, for further oil/water separation. Wet crude oil input into a dehydrator unit still contains some free salty water, and salty water in the form of an emulsion. The emulsion is separated into layers of oil and water by electrostatic coalescence. Electrostatic coalescence applies an electric current, causing water droplets in an emulsion to collide, coalesce into larger (heavier) drops, and settle out of the crude oil as separate liquid water. This process partially dries wet crude oil. Oily water proceeds to the oil/water separation unit 230 by stream 292 for treatment and oil water separation. Operating conditions of a dehydrator unit include temperature in a range of from about 130° F. to about 160° F., and a pressure at about 25 psig above the crude vapor pressure.

Optionally, partially-dried crude oil, still containing some salty water in emulsion, goes to a first stage desalter unit. Partially dried crude oil proceeds from a dehydrator unit to a first stage desalter, such as for example within dehydrating and desalting unit 278. In an optional first stage desalter, partially dried crude is mixed with recycled effluent water from an optional second stage desalter in a mixing valve. Effluent water from an optional first stage desalter can proceed to the dehydrator for washing crude oil. Operating conditions of a first stage desalter can include temperature in a range from about 130° F. to about 160° F. and a pressure at about 25 psig above the crude oil vapor pressure.

A second stage desalter, for example a unit in dehydrating and desalting unit 278, is generally the final stage of wet crude oil processing in a GOSP. Partially dried crude oil proceeds to second stage desalter from the first stage desalter. Fresh wash water (low in salt concentration relative to the crude) is injected into an inlet of a second stage desalter mixing valve. Low salinity wash water rinses the remaining salt from the crude oil.

Fresh wash water is used in the desalter process to ensure that the maximum amount of salt is rinsed from the wet crude oil. Electrostatic coalescence removes substantially any remaining water emulsion from the wet crude oil in the second stage desalter in the same way as a dehydrator unit and a first stage desalter. Effluent water from a second stage desalter goes to the first stage desalter as wash water. Operating conditions of a second stage desalter include temperature in a range from about 130° F. to about 160° F., and a pressure at about at least 25 psig above the crude vapor pressure.

The output from dehydrating and desalting unit 278 is substantially dry and desalted crude oil that passes by stream 280 to a depressurizing valve 282 and then to a cold stabilizer 284. Cold stabilizer 284 does not include reboilers, such as for example reboilers 196 from FIG. 1. Once in cold stabilizer 284, the crude oil is substantially degassed, dehydrated, and desalted, and there are two more steps before the crude oil is suitable for storage, export, and refining: sweetening and stabilization.

Sweetening involves the removal of dissolved hydrogen sulfide ($H_2S$) gas from crude oil to meet specifications in a range from about 10-60 ppm $H_2S$. The purpose of sweetening is to reduce corrosion to pipelines and eliminate health and safety hazards associated with $H_2S$. Steam in addition to or alternative to any other gas low in $H_2S$ concentration relative to the crude oil to be sweetened can be used as a stripping gas for removal of $H_2S$, for example at stripping gas stream 288. At stripping gas stream 288, a gas, steam, or mix injection at approximately 12 lbs./1000 barrel is injected at the bottom of cold stabilizer 284. Steam injection lowers the partial pressure of $H_2S$ in the crude oil. Light components in the crude oil, such as $C_1$-$C_4$ hydrocarbons, vaporize and rise through the stabilizer trays of cold stabilizer 284. Hydrogen sulfide and light hydrocarbons are removed as a gas stream at stream 286 as atmospheric off-gas, and a dry crude oil stream is discharged and collected in a dry crude oil tank before shipment to customers. The stabilizer is used to meet the RVP and $H_2S$ specifications. After stabilization and sweetening, the crude oil should meet all specifications for shipment and storage.

Stabilization is a process carried out using heating to remove any remaining dissolved gases, light, volatile hydrocarbons, and $H_2S$. Crude oil is hence split into two components: atmospheric gas from the overhead, for example at stream 286, and stabilized, sweetened crude oil from the bottoms, for example at cold stabilizer product bottom stream 290. Stabilizing crude oil is achieved when crude oil is heated in a multiple stages of separation drums working at increasing temperatures and reduced pressure.

Cold stabilizer 284 performs two functions simultaneously by sweetening sour crude oil by removing the hydrogen sulfide, and reducing the vapor pressure through removal of light, volatile hydrocarbons, thereby making the crude oil safe for shipment in pipelines. Stabilization involves the removal of light ends from crude oil, mainly $C_1$-$C_4$ hydrocarbons, to reduce the vapor pressure to produce dead or stable product that can be stored in an atmospheric tank. Stabilization aims to lower vapor pressure of crude oil to a maximum RVP of about 7 psia and a maximum TVP of about 13.5 psia at 130° F., or in other words low enough so no vapor will flash under atmospheric conditions, making it safe for transportation and shipment. Operating conditions of a stabilizer, such as for example cold stabilizer 284, include temperature in a range from about 160° F. to about 200° F. and pressure from about 3 psig to about 5 psig.

Oil from the dehydrating and desalting unit 278 rises to the top of cold stabilizer 284 and is distributed onto a top tray. Cold stabilizer 284 has a number of trays (for example up to about sixteen), whereby crude oil flows down over each tray until it reaches a draw-off tray. Light components in the crude oil vaporize and rise through the stabilizer trays. Hydrogen sulfide and light hydrocarbons are removed as tops at stream 286, which is compressed in atmospheric pressure compressor 268 and then proceeds to compressed atmospheric off-gas stream 250 to form LPPT inlet stream 252.

Dry crude oil exits by cold stabilizer product bottom stream 290 from the bottom of cold stabilizer 284 and is discharged and collected in a dry crude oil tank before shipment to customers. Cold stabilizer 284 is used to meet RVP and $H_2S$ specifications. After stabilization and sweetening, the crude oil should meet all specifications required for shipment, transport, and storage. These specifications include the following: (1) a salt concentration of not more than about 10 PTB; (2) BSW of not more than about 0.3 V %; (3) $H_2S$ content of less than about 60 ppm in either the crude stabilization tower (or degassing vessels in the case of sweet crude); and (4) a maximum RVP of about 7 psia and a maximum TVP of about 13.5 psia at 130° F.

Oil/water separation unit 230 collects oily water from streams from HPPT 208, LPDT 258, and dehydrating and desalting unit 278, and separates oil from the collected water. Wastewater is discharged to disposal water wells and extracted oil is recycled and conveyed to LPDT 164 by stream 294. Notably, in certain embodiments of the disclosure, as can be seen in FIG. 2, LPPT 234 is used in place of an atmospheric compressor discharge KOD, such as for example discharge KOD 178, by applying compressed atmospheric off-gas stream 250 to form LPPT inlet stream 252. Additionally, by applying compressed atmospheric off-gas stream 250 to form LPPT inlet stream 252, an atmospheric compressor aftercooler, such as for example cooler 176 in FIG. 1, will not be required. Moreover, a hydrocarbon condensate pump following an atmospheric discharge KOD will not be required, such as for example hydrocarbon condensate pump 183 in FIG. 1.

In the embodiment of FIG. 2, HPPT 208 functions as a low pressure compressor discharge KOD, such as for example discharge KOD 148 in FIG. 1. A low pressure compressor aftercooler is not required in the embodiment of FIG. 2, for example cooler 146. A low pressure hydrocarbon condensate pump is not required by the embodiment of FIG. 2, for example hydrocarbon condensate pump 153 in FIG. 1. In some embodiments, first heat exchanger 256 can be eliminated depending on the compressed gas heat duty and the feed inlet temperature of crude oil feed stream inlet 202. In the embodiment of FIG. 2, off-gases are used to increase the product yield.

For example, when mixing hot discharge gases from one or more atmospheric compressors with cold crude oil before an LPPT, and when mixing hot discharge gases from one or more low pressure compressors with cold crude before an HPPT, heavy hydrocarbons in the off-gases (such as for example C5+ hydrocarbons) will condense into the crude which will increase the yield of the crude oil, rather than losing heavy hydrocarbons in the off-gases as collected condensates in additional, separate knockout drums.

Hot gas, for example in compressed LPPT off-gas stream 246 and compressed atmospheric off-gas stream 250, will simultaneously heat crude oil in the integrated GOSP system and process 200 and improve emulsified water separation in HPPT 208 and LPPT 234. Heating a GOSP inlet feed enables better separation in the HPPT, LPPT, and LPDT, because the feed crude oil oftentimes arrives at ambient low temperatures due to the long length of a pipeline. Low arrival temperatures for certain Arab light and Arab heavy crude grades dramatically reduces water separation efficiency. The embodiment of FIG. 2 also eliminates stabilizer reboilers, such as for example reboilers 196 in FIG. 1. And, while the system of FIG. 1 uses six separate KOD units, 114, 120, 142, 148, 172, and 178, the embodiment of FIG. 2 uses only four separate KOD units, 214, 220, 242, and 264.

Higher LPPT and HPPT operating temperatures also aid in crude sweetening and stabilization, for example in cold stabilizer 284. In some embodiments, integrated GOSP system and process 200 can be used to process light crude or extra light crude grades. For example, in some applications in Saudi Arabia, crude oil grade is measured by the American Petroleum Institute (API) range as follows: Arabian Super Light (49-52 API); Arabian Extra Light (37-41 API); and Arabian Light (32-36 API). API=141.5/(crude oil specific gravity)−131.5.

Referring now to FIG. 3 a schematic diagram is provided showing an integrated GOSP of the present disclosure used for processing crude oil. In some embodiments, integrated GOSP system and process 300 can be used to process medium crude or heavy crude grades. For example, in some applications in Saudi Arabia, crude oil grade is measured by the API range as follows: Arabian Medium (28-32 API) and Arabian Heavy (26-28 API). API=141.5/(crude oil specific gravity)−131.5.

Integrated GOSP system and process 300 includes a crude oil feed stream inlet 302 comprising wet crude oil, and crude oil feed stream inlet 302 is fluidly coupled to a demulsifier injection port 304, a mixing valve 306, and a LPPT 308. LPPT 308 includes an inlet diverter 310 for thoroughly mixing wet crude oil with any other additives, such as one or more demulsifiers. In LPPT 308, crude oil undergoes an initial three-phase separation to remove most of the gasses and free-formation water. LPPT 308 operates at a pressure of about 50 psig.

Low pressure gas from LPPT 308 proceeds via low pressure gas stream 312 to a suction KOD 314, a low pressure compressor 316, a cooler 318, and a discharge KOD 320. A tops stream 322 from discharge KOD 320 comprises low pressure gas which proceeds to dehydration and dewpoint control units by tops stream 322. Condensate flows from suction KOD 314 and discharge KOD 320 proceed by condensate outlet streams 324, 326, 328. Gas is compressed in low pressure compressor 316 and then cooled in cooler 318 to condense hydrocarbons and other gases heavier than ethane, before being directed to the discharge KOD 320 and other dehydration and dewpoint control units by tops stream 322. Condensed fluids from suction KOD 314 and discharge KOD 320, such as, for example, water, are discharged for collection and treatment in an oil/water separation unit, such as for example oil/water separation unit 330. LPPT 308 is a horizontal two-phase separation vessel that separates off-gas from wet crude oil. The operating conditions in LPPT 308 include temperature in a range from about 65° F. to about 130° F. and operating pressure at about 50 psig.

Wet crude oil in LPPT outlet stream 332 proceeds to a LPDT 334, through first heat exchanger 336. Oily water in oily water outlet stream 338 proceeds to oil/water separation unit 330. Wet crude oil in LPPT outlet stream 332 still contains some water and gas after LPPT 308, and proceeds to the next stage in integrated GOSP system and process 300, which is the LPDT 334 for removing remaining off-gas.

Wet, unstabilized crude oil from oil production wells (not shown) in crude oil feed stream inlet 302 mixes with hot, atmospheric pressure compressor discharge gas before entering LPPT 308, which in some embodiments operates at about 50 psig. Before wet crude oil proceeds to LPPT 308, it is mixed with a compressed atmospheric off-gas stream 340 to form LPPT inlet stream 342. Compressed atmospheric off-gas stream 340 heats incoming crude oil in crude oil feed stream inlet 302. Compressed atmospheric off-gas stream 340 and LPPT 308, in some embodiments, operate at about 50 psig. Heating wet crude oil with the compressed atmospheric off-gas stream 340 allows for more efficient separation of gases from the crude oil and allows for increased water separation efficiency. Crude oil in LPPT outlet stream 332 proceeds to first heat exchanger 336 to be heated, before entering LPDT 334, operating at less than about 5 psig, for further gas and water separation. Heating wet crude oil allows for more efficient gas separation from the crude oil, allows for more efficient stabilizing processes, and allows for increased water separation efficiency.

From LPDT 334, an oily water stream 344 proceeds to oil/water separation unit 330 for treatment and separation. Atmospheric off-gas stream 346 proceeds to KOD 348, in which condensates such as for example water and other condensates are removed by condensate stream 350. Atmospheric off-gas proceeds to atmospheric pressure compressor 352 and then to be mixed with crude oil feed stream inlet 302 by compressed atmospheric off-gas stream 340 to form LPPT inlet stream 342. In embodiments of the present disclosure, compressor discharge gases can be in a temperature range of from about 240° F. to about 270° F.

Wet crude oil stream from LPDT 334 is pumped through one or more crude charge pumps 354 and is conveyed to a trim heat exchanger 356 to increase temperature of the crude oil. Fresh wash water stream 358 is mixed with wet crude oil from LPDT 334 at mixing valve 360, before proceeding to a dehydrator and desalting unit 362. Heating a wet, degassed crude oil stream 364 enhances the efficiency of dehydrating and desalting unit 362. Heat exchangers in embodiments of the present disclosure can be tube/shell types where cold, wet crude oil passes though the tubes and the heating medium is placed inside an outer shell.

A dehydrator is a horizontal vessel where a first stage of drying wet crude oil takes place. Washing and electrostatic coalescence of water takes place in a dehydrator vessel along with or alternative to desalter units, such as for example dehydrating and desalting unit 362 for further oil/water separation. Wet crude oil input into a dehydrator unit still contains some free salty water, and salty water in the form of an emulsion. The emulsion is separated into layers of oil and water by electrostatic coalescence. Electrostatic coalescence applies an electric current, causing water droplets in an emulsion to collide, coalesce into larger (heavier) drops, and settle out of the crude oil as separate liquid water. This process partially dries wet crude oil. Oily water proceeds to the oil/water separation unit 330 by stream 366 for treatment and oil water separation. Operating conditions of a dehydrator unit include temperature in a range of from about 130° F. to about 160° F., and a pressure at about 25 psig above the crude vapor pressure.

Optionally, partially-dried crude oil, still containing some salty water in emulsion, goes to a first stage desalter unit. Partially dried crude oil proceeds from a dehydrator unit to a first stage desalter, such as for example within dehydrating and desalting unit 362. In an optional first stage desalter, partially dried crude is mixed with recycled effluent water from an optional second stage desalter in a mixing valve. Effluent water from an optional first stage desalter can proceed to the dehydrator for washing crude oil. Operating conditions of a first stage desalter can include temperature in a range from about 130° F. to about 160° F. and a pressure at about 25 psig above the crude vapor pressure.

A second stage desalter, for example a unit in dehydrating and desalting unit 362, is generally the final stage of wet crude oil processing in a GOSP. Partially dried crude oil proceeds to second stage desalter from the first stage desalter. Fresh wash water (low in salt concentration relative to the crude) is injected into an inlet of a second stage desalter mixing valve. Low salinity wash water rinses the remaining salt from the crude oil.

Fresh wash water is used in the desalter process to ensure that the maximum amount of salt is rinsed from the wet crude oil. Electrostatic coalescence removes substantially any remaining water emulsion from the wet crude oil in the second stage desalter in the same way as a dehydrator unit and a first stage desalter. Effluent water from a second stage desalter goes to the first stage desalter as wash water. Operating conditions of a second stage desalter include temperature in a range from about 130° F. to about 160° F., and a pressure at about at least 25 psig above the crude vapor pressure.

The output from dehydrating and desalting unit 362 is substantially dry and desalted crude oil that passes by stream 368 to a depressurizing valve 370 and then to a cold stabilizer 372. Cold stabilizer 372 does not include reboilers, such as for example reboilers 196 from FIG. 1. Once in cold stabilizer 372, the crude oil is substantially degassed, dehydrated, and desalted, and there are two more steps before the crude oil is suitable for storage, export, and refining: sweetening and stabilization.

Sweetening involves the removal of dissolved hydrogen sulfide ($H_2S$) gas from crude oil to meet specifications in a range from about 10-60 ppm $H_2S$. The purpose of sweetening is to reduce corrosion to pipelines and eliminate health and safety hazards associated with $H_2S$. Steam in addition to or alternative to any other gas low in $H_2S$ concentration relative to the crude oil to be sweetened can be used as a stripping gas for removal of $H_2S$, for example at stripping gas stream 374. At stripping gas stream 374, a gas, steam, or mix injection at approximately 12 lbs./1000 barrel is injected at the bottom of cold stabilizer 372. Steam injection lowers the partial pressure of $H_2S$ in the crude oil. Light components in the crude oil, such as $C_1$-$C_4$ hydrocarbons, vaporize and rise through the stabilizer trays of cold stabilizer 372. Hydrogen sulfide and light hydrocarbons are removed as a gas stream at stream 376 as atmospheric off-gas, and a dry crude oil stream is discharged and collected in a dry crude oil tank before shipment to customers. The stabilizer is used to meet the RVP and $H_2S$ specifications. After stabilization and sweetening, the crude oil should meet all specifications for shipment and storage.

Stabilization is a process carried out using heating to remove any remaining dissolved gases, light, volatile hydrocarbons, and $H_2S$. Crude oil is hence split into two components: atmospheric gas from the overhead, for example at stream 376, and stabilized, sweetened crude oil from the bottoms, for example at cold stabilizer product bottom stream 378. Stabilizing crude oil is achieved when crude oil is heated in a multiple stages of separation drums working at increasing temperatures and reduced pressure.

Cold stabilizer 372 performs two functions simultaneously by sweetening sour crude oil by removing the hydrogen sulfide, and reducing the vapor pressure through removal of light, volatile hydrocarbons, thereby making the crude oil safe for shipment in pipelines. Stabilization involves the removal of light ends from crude oil, mainly $C_1$-$C_4$ hydrocarbons, to reduce the vapor pressure to produce dead or stable product that can be stored in an atmospheric tank. Stabilization aims to lower vapor pressure of crude oil to a maximum RVP of about 7 psia and a maximum TVP of about 13.5 psia at 130° F., or in other words low enough so no vapor will flash under atmospheric conditions, making it safe for transportation and shipment. Operating conditions of a stabilizer, such as for example cold stabilizer 372, include temperature in a range from about 160° F. to about 200° F. and pressure from about 3 psig to about 5 psig.

Oil from the dehydrating and desalting unit 362 rises to the top of cold stabilizer 372 and is distributed onto a top tray. Cold stabilizer 372 has a number of trays (for example up to about sixteen), whereby crude oil flows down over each tray until it reaches a draw-off tray. Light components in the crude oil vaporize and rise through the stabilizer trays. Hydrogen sulfide and light hydrocarbons are removed as tops at stream 376, which is compressed in atmospheric pressure compressor 352 and then proceeds to compressed atmospheric off-gas stream 340 to form LPPT inlet stream 342.

Dry crude oil exits by cold stabilizer product bottom stream 378 from the bottom of cold stabilizer 372 and is discharged and collected in a dry crude oil tank before shipment to customers. Cold stabilizer 372 is used to meet RVP and $H_2S$ specifications. After stabilization and sweetening, the crude oil should meet all specifications required for shipment, transport, and storage. These specifications include the following: (1) a salt concentration of not more than about 10 PTB; (2) BSW of not more than about 0.3 V %; (3) $H_2S$ content of less than about 60 ppm in either the crude stabilization tower (or degassing vessels in the case of sweet crude); and (4) a maximum RVP of about 7 psia and a maximum TVP of about 13.5 psia at 130° F.

Oil/water separation unit 330 collects oily water from streams from LPPT 308, LPDT 334, and dehydrating and desalting unit 362, and separates oil from the collected water. Wastewater is discharged to disposal water wells and extracted oil is recycled and conveyed to LPDT 334 by stream 380. Notably, in certain embodiments of the disclosure, as can be seen in FIG. 3, LPPT 308 is used in place of an atmospheric compressor discharge KOD, such as for example discharge KOD 178, by applying compressed atmospheric off-gas stream 340 to form LPPT inlet stream 342. Additionally, by applying compressed atmospheric off-gas stream 340 to form LPPT inlet stream 342, an atmospheric compressor aftercooler, such as for example cooler 176 in FIG. 1, will not be required. Moreover, a hydrocarbon condensate pump following an atmospheric discharge KOD will not be required, such as for example hydrocarbon condensate pump 183 in FIG. 1.

In some embodiments, first heat exchanger 336 can be eliminated depending on the compressed gas heat duty and the feed inlet temperature of crude oil feed stream inlet 302. In the embodiment of FIG. 3, the use of off-gas increases the product yield.

Hot gas, for example in compressed atmospheric off-gas stream 340, in some embodiments between about 240° F. and about 270° F., will simultaneously heat crude oil in the integrated GOSP system and process 300 and improve emulsified water separation in LPPT 308. Heating a GOSP inlet feed enables better separation in the LPPT and LPDT, because the feed crude oil oftentimes arrives at ambient low temperatures due to the long length of a pipeline. Low arrival temperatures for certain Arab light and Arab heavy crude grades dramatically reduces water separation efficiency. The embodiment of FIG. 3 also eliminates stabilizer reboilers, such as for example reboilers 196 in FIG. 1. And, while the system of FIG. 1 uses six separate KOD units, 114, 120, 142, 148, 172, and 178, the embodiment of FIG. 3 uses only three separate KOD units, 314, 320, and 348.

Higher LPPT and HPPT operating temperatures also aid in crude sweetening and stabilization, for example in cold stabilizer 372.

Although the disclosure has been described with respect to certain features, it should be understood that the features and embodiments of the features can be combined with other features and embodiments of those features.

Although the disclosure has been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a," "an," and "the" include plural referents, unless the context clearly dictates otherwise.

As used throughout the disclosure and in the appended claims, the words "comprise," "has," and "include" and all grammatical variations thereof are each intended to have an open, non-limiting meaning that does not exclude additional elements or steps.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

While the disclosure has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present disclosure may suitably comprise, consist or consist essentially of the elements disclosed and may be practiced in the absence of an element not disclosed.

What is claimed is:

1. An integrated gas oil separation plant system, the system comprising:

a crude oil inlet feed stream;

a high pressure production trap (HPPT), where the HPPT is fluidly coupled to the crude oil inlet feed stream, and where the HPPT comprises an inlet mixing device operable to thoroughly mix the crude oil inlet feed stream with an additional fluid;

a low pressure production trap (LPPT), where the LPPT is fluidly coupled to the HPPT, and where the LPPT comprises an inlet mixing device operable to thoroughly mix an LPPT inlet feed stream;

a low pressure degassing tank (LPDT), where the LPDT is fluidly coupled to the LPPT;

a first knockout drum (KOD) fluidly coupled to the LPDT and operable to accept an atmospheric pressure off-gas from the LPDT;

an atmospheric pressure compressor fluidly coupled to the first KOD and operable to compress the atmospheric pressure off-gas to introduce the atmospheric pressure off-gas from the LPDT into the LPPT inlet feed stream;

a second KOD fluidly coupled to the LPPT and operable to accept a low pressure off-gas from the LPPT; and a low pressure compressor fluidly coupled to the second KOD and operable to compress the low pressure off-gas to introduce the low pressure off-gas from the LPPT into the crude oil inlet feed stream.

2. The system according to claim 1, further comprising at least one heat exchanger operable to heat crude oil.

3. The system according to claim 1, further comprising a third KOD operable to accept a high pressure off-gas from the HPPT; a high pressure compressor fluidly coupled to the third KOD; a cooler fluidly coupled to the high pressure compressor; and a fourth KOD fluidly coupled to the cooler.

4. The system according to claim 3, further comprising at least one dehydrator unit operable to substantially dehydrate crude oil and at least one desalter unit operable to substantially desalt crude oil.

5. The system according to claim 4, further comprising a cold stabilizer, where an atmospheric off-gas outlet of the cold stabilizer is fluidly coupled to the first KOD.

6. The system according to claim 5, further comprising an oil/water separator device operable to accept an oily water output stream from the HPPT, and accept an oily water output stream from the LPDT, and where the oil/water separator device is operable to separate oil from water, and operable to recycle oil to the LPDT.

7. The system according to claim 6, where the cold stabilizer further comprises a stripping gas stream, where the stripping gas stream is operable to supply steam in addition to or alternative to an additional stripping gas low in $H_2S$ concentration relative to crude oil in the cold stabilizer, where the stripping gas stream is operable to lower concentration of $H_2S$ in crude oil in the cold stabilizer.

8. The system according to claim 7, where the system is operable to refine crude oil in the crude oil inlet feed stream to produce a refined crude oil product safe for storage and shipment meeting the following specifications: (1) a salt concentration of not more than about 10 pound (lbs.) of salt/1000 barrels (PTB); (2) basic sediment and water (BSW) of not more than about 0.3 volume percent (V %); (3) $H_2S$ concentration of less than about 60 ppm; and (4) a maximum RVP of about 7 pounds per square inch absolute (psia) and a maximum true vapor pressure (TVP) of about 13.5 psia at 130 degrees Fahrenheit (° F.).

9. The system according to claim 1, where operating pressure within the HPPT is greater than operating pressure within the LPPT, and where operating pressure within the LPPT is greater than operating pressure in the LPDT.

10. The system according to claim 7, where the system is operable to dehydrate, desalt, sweeten, and stabilize crude oil to produce crude oil safe for storage and shipment with only four KOD's.

* * * * *